United States Patent [19]

Austin

[11] Patent Number: 4,488,747

[45] Date of Patent: Dec. 18, 1984

[54] METHOD AND FISHING TOOL APPARATUS FOR RECOVERING OBJECTS FROM WELLS

[76] Inventor: George Austin, P.O. Box 3143, Park City, Utah 84060

[21] Appl. No.: 407,446

[22] Filed: Aug. 12, 1982

[51] Int. Cl.[3] ..... E21B 31/12

[52] U.S. Cl. ..... 294/86.1

[58] Field of Search ..... 294/86.1, 86.2, 86.24, 294/86.25, 86.26, 86.27, 86.28, 86.29, 86.30, 86.31, 86.32, 86.12, 86.13, 86.14, 86.17, 86.18, 86.19, 86.21, 61, 66 R

[56] References Cited

U.S. PATENT DOCUMENTS

| | | | |
|---|---|---|---|
| 2,154,654 | 4/1939 | Armentrout et al. | 294/86.1 |
| 2,218,131 | 10/1940 | Gipson et al. | 294/86.1 |
| 4,397,494 | 8/1983 | Carver | 294/86.1 |

*Primary Examiner*—James B. Marbert

[57] ABSTRACT

This invention relates to fishing tools for first determining the orientation of an object before retrieving said object from a well, well bore, casing, and the like. It comprises a base with a plurality of electrode welding tips retractably attached thereto and displaced in preselected pattern. Signals are generated as the electrode tips come into contact with the object indicating the orientation of the object. Electrical welding current is then selectively applied to a desired electrode to attach to the object for retrieval.

11 Claims, 5 Drawing Figures

METHOD AND FISHING TOOL APPARATUS FOR RECOVERING OBJECTS FROM WELLS

BACKGROUND OF THE INVENTION

1. Field

This method and invention relates to recovering drilling tools and objects from wells. More particularly, it is a fishing tool apparatus and method for determining the orientation of an object before recovering said object by means of a flash weld.

2. State of the Art

In downhole drilling, long drill stems are used to drive drilling equipment and bits located at the bottom of the hole. The length of the stem generates extreme tensions and pressures on the drilling system, ocassionally causing severence or breakage. When pieces of the drilling equipment detach, they must be removed from the hole before further drilling. To remove these objects from the well, various fishing tool devices have been developed. W. W. Gipson, U.S. Pat. No. 2,218,131 discloses a device to recover objects by flash welding electrodes to the object and then retrieving the electrodes with the object attached. The device has a plurality of electrodes which are brought into contact with the object by cables, drill pipe, etc. and flash welded to said object. A. L. Armentrout et al, U.S. Pat. No. 2,154,654 is another fishing tool using welding electrodes. It includes an air source associated with the electrodes to provide an air screen to shield the electrodes for better welding contact between the object and the electrodes. It also includes means to indicate when the electrodes contact the object. Foster, U.S. Pat. No. 2,789,004 uses a plurality of thermite cartridges, instead of electrodes, for welding the fishing tool to the object. These cartridges are brought into contact with and welded to the object. Retrieval of the object is accomplished in a similar fashion as electrode fishing tool devices.

Because the objects to be retrieved may not be centrally aligned within the well bore, the electrodes, or thermite cartridges, may attach to the object in a position which causes the object to wedge against the bore as the fishing tool is withdrawn. Thus, there is a need to determine the orientation of the object in the well before welding an electrode or thermite cartridge to the object. Presently a lead impression block is used for this purpose. The lead block is lowered from the surface and brought into contact with the object. The lead block is then pounded against the object until an impression in the block of the object is formed. The lead block is then withdrawn and inspected to determine the orientation of the object. A fishing tool is then inserted to flash weld to and retrieve the object. This procedure requires the drill stem to be dissassembled and assembled twice to retrieve an object. Also, since the lead block may rotate upon withdrawal, the direction of the lie of the object cannot be precisely determined. Thus, a weld may be etfectuated with an electrode or thermite cartridge attaching at a point which causes wedging when the fishing tool is withdrawn.

C. F. Farmer, U.S. Pat. No. 3,441,307, discloses an electromagnetic well service tool which retrieves ferromagnetic objects by use of strong electromagnets. These electromagnets are attached to the fishing tool and brought into contact with the object to be retrieved. The magnets are then activated to magnetically attract the object. The electromagnets, with the object attached, are then withdrawn from the well. These electromagnetic well service tools may lose objects if the electromagnetic field is weakened by conditions encountered within the well upon withdrawal. Also, the electromagnets carrying an object may attach to well casings upon withdrawal, dislodging the object.

SUMMARY OF THE INVENTION

The fishing tool comprises a base sized to fit within a well, well bore, casing, and the like. The base has a downhole side structured to attach to a plurality of electrodes with attachment ends. The electrodes are retractably mounted to the downhole side of the base. Each electrode is biased to extend its attachment end from the base in a pre-selected pattern essentially interspersed within the cross-sectional area of the well bore. Welding tips are attached to the attachment end and electrically associated with the electrodes. The tips when activated by a power source, form a weld with an object. The electrodes are formed of a carbon material, or the like, which will not melt when activated. Conversely, the tips melt and form the weld. The tips may be made of silver, or other similar materials capable of forming an arc weld. Preferably, the material for the tip will shield the weld from contamination by the mud. Used tips are generally removed after use, and replaced.

Means to run the fishing tool in and out of the well, e.g. a drill stem or cable, are removably attached to the base via threads, hooks, etc. to bring the electrode tips into contact with the object to be retrieved. As the tips of the electrodes contact the object, they retract, forming a pattern which conforms to the surface shape of the object. In one preferred embodiment, means to extend and retract the base, e.g. a hydraulic cylinder system, are associated with the means to run the fishing tool in and out of the well, e.g. drill stem. The fishing tool may then be selectively raised and lowered from the point the electrodes initially contact the object to take readings as to the manner and sequence in which the electrode tips contact the surface of the object. In more elaborate systems, a hydraulic cylinder system, or similar means, is associated with each electrode to selectively extend and retract the electrode tips from the base after the electrode tips initially contact the object. By extending the electrode tips in this manner, the sequence that the electrode tips contact the object may be verified before a flash weld is generated.

Associated with each electrode are interface circuitry means to complete a separate electrical circuit between each electrode tip and the object. The interface circuitry means are activated by the first mode of switching means controlling the electrical power source. In the first mode, a low voltage sensing current is generated through the interface circuitry means. Electrical impulses are thus generated as the object is encountered indicating which and how long, each electrode tip contacts the object. For example, a low voltage positive or negative potential is imposed over the welding tip of one electrode via wire leads in communication with the power source. This welding tip acts as a reference electrode. The opposite charge potential is imposed over the remaining welding tips via wire leads, also in communication with the power source. As the tips are brought into contact with the object to be welded, a circuit is completed between the object and those welding tips in contact with the object. Electrical impulses pass through each completed circuit, and are converted into audio or visual signals by display means, e.g. lights, or buzzers contained in a control panel located at the surface of the well. The well operator can determine the configuration and lie of the object by interpreting the audio or visual signals reflecting which tips contacted the object, and the sequence in which contact was made.

The switching means are usually contained in the control panel. It is associated with the electrical power source and each electrode tip. After the operator selects which tip or tips are to be activated, a second mode of the switching means is activated to direct a high amperage current through the desired electrode tip or tips to form a weld with the object.

The fishing tool, with the object attached, is then withdrawn from the well.

More sophisticated interface circuitry means may be associated with each welding tip to reflect their exact displacement. For example, induction switches may be associated with each electrode to emit an impulse with a frequency proportional to the displacement of the electrode tip from the base. These impulses are then translated by logic circuits included with the display means of the control panel to emit an appropriate audio or visual signal indicating the displacement of each electrode tip.

To shield the electrodes from catching on the side of the well, well bore, casing, or the like, a moveable sleeve may be slideably mounted to the base to extend and cover the electrodes during the descent of the fishing tool. As the electrodes approach the object, the sleeve is retracted to expose the electrodes. For example, mechanical means, such as a catch mounted to the base and holding the sleeve, may be released by a cable operated from the surface, to release and pull back the sleeve. An electrical catch mounted to the base and activated by the control panel may also be adapted to release the sleeve.

After an electrode tip, or tips, has been welded to the object, the sleeve may be slid back over the electrode tips and the attached object. The fishing tool and the object are then withdrawn from the well. This sleeve acts to prevent the object from snagging on the side of the well when the fishing tool is retrieved.

The sleeve may include a plurality of inside slips which, when extended, press inwardly after passing over the object, narrowing the sleeve opening to prevent the object from falling in the event of accidental detachment as the fishing tool is retrieved.

The power source is perferably located at the surface of the well, but may be mounted to the base of the fishing tool. The power source is capable of generating low amperage sensing electrical current, or, alternatively, high amperage flash welding electrical current. The power source is controlled by the control panel switching means which selectively applies appropriate current to the electrode tips in response to the operator's instructions.

Where water and muds are encountered in the bottom of a well, a source of gas to provide a gas screen to maintain better electrical contact between the tips and the object, may be included. The gas source may be located at the surface of the well, or can be mounted to the base. A gas stream from the gas source is delivered via delivery means, e.g. tubes or conduits. Structure, such as deflectors associated with the delivery means, direct a gas stream to shield the welding tips from liquids or muds. The types of gases used are well known in the art, e.g., air, nitrogen, etc.. They are selected to facilitate flash welding under the conditions encountered near the object.

Also, associated with the fishing tool is a series of openings or tubes extending through the tool through which drilling mud or air may be pumped to clear away any backfill which has fallen on top of the object to be retrieved. Compressed air is preferred in air drilling operations, although other similar gases may be used.

In one preferred embodiment, the welding tips are removably attached to a plurality of radially displaced electrode attachment ends. The tips are each mounted to a plurality of flexible arms, each having a first and second end. The first end is attached to the tip. The second end is attached proximate the center of the downhole side of the base. After the tip, or tips, is selectively welded to the object, the tip with object attached separates from the electrode attachment end as the fishing tool is withdrawn. The loaded arm bends dragging the object attached to the tip toward the center of the well bore, thus minimizing the chance that the object will wedge against the well bore.

The welding tips are aligned in a pre-selected pattern radially displaced beneath the downhole side of the bore. The number of welding tips is selected such that an operator will have sufficient information from the number of welding tip contacts to determine the orientation and lie of the object. For example, a reference electrode retractably extending from the center of the downhole side of the base is surrounded by eight radially displaced electrodes in a circular pattern. The welding tips attached to the electrodes are aligned in a plane corresponding to the cross-sectional area of the well bore. As the electrodes are brought into contact with the object, the operator can determine the orientation of the object from the signals indicating the amount of displacement of each welding tip.

To insure proper alignment of the welding tips within the well, the base may include structure to prevent the base from tipping when the tips are brought in contact with an object. Relative alignment of the base within the well avoids generation of erroneous impulses regarding the orientations and lie of the object. For example, the base may be sized proximate the diameter of the well bore, and elongated to maintain the downhole side of the base in alignment with the cross-sectional diameter of the well.

Applicant's fishing tool when used, thus provides a method for first determining object orientation and then retrieving objects rom within a well, well bore, casing, and the like. It comprises: (1) providing a base with a downhole side; (2) retractively attaching and biasing a plurality of electrodes with fusible welding tips to the base to extend the tips in an initial pattern from the downhole side; (3) running the base into the well to bring the tips into contact with the object; (4) generating signals as to the sequence each tip contacts the object: (5) interpreting the signals to determine the orientation of the object within the well; (6) selectively activating an electrical power source associated with each welding tip to flash weld at least one tip to the object; and (7) retrieving the base with the object welded thereto from the well. The method may also include generating displacement signals as to the relative displacement of each tip when brought into contact with the object. These displacement signals provide additional information as to the orientation of the object. They are translated by logic circuitry means which enable the operator to more precisely determine the lie of the object.

DESCRIPTION OF THE ILLUSTRATED EMBODIMENTS

Figures 1, 2, 3:
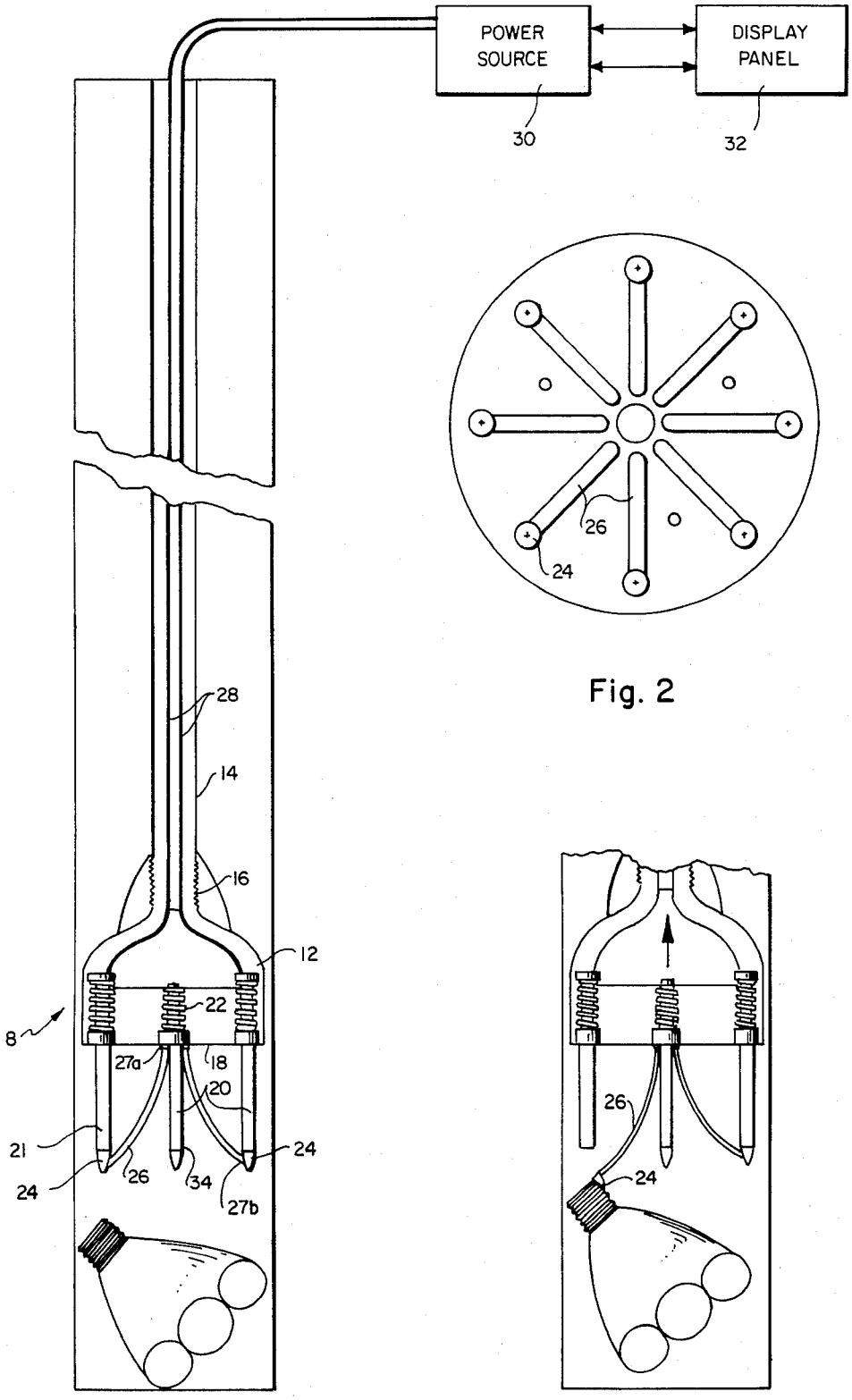
FIG. 1 is a perspective view of the invention.
FIG. 2 is a cross-sectional view of the electrode tips shown in contact with an object.
FIG. 3 is a perspective view of the invention with an object welded to an electrode tip.

Applicant's invention 10 comprises a base 12 with means to attach to a drill stem 14, illustrated as a male threaded end 16. The base 12 has a downhole side 18 with apertures (not shown) through which a plurality of electrodes 20 are retractably mounted. Said electrodes 20 are biased to extend one end 21 from the downhole side 18 by springs 22. Welding tips 24 are removably attached to the extended end 21 of the electrodes 20. These tips 24 are affixed to a flexible arm 26 with a first end 27*a* attached proximate the center of the downhole side 18. The flexible arm 26 has a second end 27*b* attached to the tips 24. Wire leads 28 connect an electrical power source 30, e.g. generator, with each electrode 20. The power source 30 is in communication with a control display panel 32 which includes switching means (not shown) to regulate the electrical power output, and display means (not shown). The display means indicates which tip 24 has made contact with the object to be retrieved, and the contact sequence.

FIGS. 1 and 2 illustrates the tips 24 radially displaced about a central reference electrode 34. The tips 24 and 34 selectively contact the surface of the object to be retrieved, and retract essentially forming a pattern conforming to the surface of the object.

FIG. 3 illustrates a tip 24 selectively welded to the object. As the fishing tool 10 is withdrawn from the well, the flexible arm 26 bends and drags the object toward the center of the well to avoid wedging the object against the side of the well, as shown in FIG. 4.

Figures 4, 5:
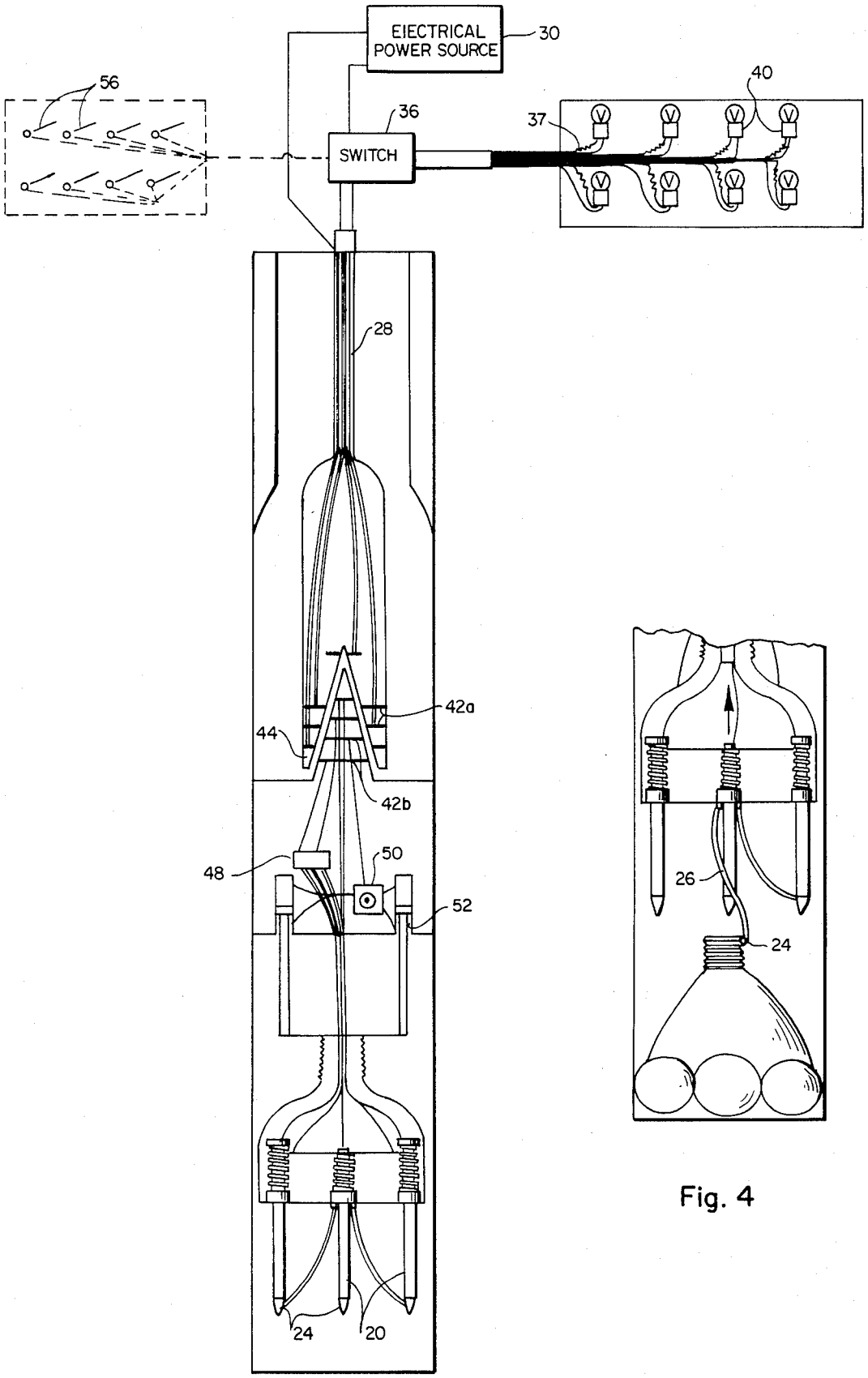
FIG. 4 is another perspective view of the invention with an object welded to an electrode tip.
FIG. 5 is a perspective view of another embodiment of the invention.

FIG. 5 is another embodiment of the invention. It illustrates an electrical power source 30 controlled by a switch 36. In its first mode, the switch 36 passes a circuit through a series of resistors 37 associated with the wire leads 28. A low voltage sensing current results operating a control panel 38. The control panel 38 includes a plurality of light bulbs 40, each wired in a separate circuit with an electrode 20, via wire leads 28. At least one electrode 20 has a positive potential, and the others have a negative potential. In this particular embodiment, metal bands 42*a* at the end 44 of the drill stem 46 are in communication with the wire leads 29. As the end 44 of the drill stem 46 is screwed on to the male threaded end 16 of the fishing tool 8, corresponding metal bands 42*b* are brought into electrical contact. A second set of wire leads 46 lead to a distributor 48 which connects with each electrode 20 with a third set of wire leads 48. As the tips 24 of the electrodes 20 are brought into contact with the object, electrical circuits are completed, causing a response in the appropriate light bulb 40 to indicate when and which electrode has made contact with the object.

An electrical hydraulic pump 50 is attached to the base 10. It provides fluid to hydraulic cylinders 52 mechanically associated with a welding head 54 to which the electrodes 20 are retractably mounted and biased to extend the tips 24 from the head 54. The pump 50 is activated by a control panel switch (not shown) to extend and retract the welding head 54 from the base 10. As the base 10 retracts or extends, tip contact with the object is noted. The sequence of light flashes indicates the orientation of the object.

The switch 36 is then flipped into its second mode bypassing the resistors 37 to deliver high amperage welding current through a second set of switches 56 controlling current to each welding tip 24. The switches 56, when selectively activated, direct current across the desired tip 24.

Although the specification has made reference to the illustrated embodiments, no intention is made to restrict the scope of the appended claims. The claims, themselves, recite any restrictions necessary for the invention.

I claim:

1. A fishing tool apparatus for retrieving objects from within a well, well bore, casing, and the like comprising:

a base sized to fit within the well, with a downhole side;

a plurality of electrodes with fusible tips, retractably mounted to the base and biased to extend the tips from the downhole side, said tips structured to displace and drag objects welded thereto in a manner minimizing snagging on the casing as the fishing tool is withdrawn;

means for running the base in and out of the well to bring the electrodes into contact with the object:

an electrical power source operably associated with the electrode tips to complete an electric circuit through at least one electrode tip and the object to fuse said tip to the object;

interface circuitry means operably associated with each electrode tip to generate impulses indicating when each electrode tip contacts the object; and a control panel having:

(a) display means in communication with the interface circuitry means to emit audio or visual signals in response to the impulses; and (b) switching means having a first mode associated with the power source and interface circuitry means to activate said interface circuitry means, and a second mode associated with the power source and electrodes to selectively activate at least one welding tip to weld to the object.

2. An apparatus according to claim 1, wherein the interface circuitry means generate impulses indicating the amount of displacement of each electrode tip when brought into contact with the object.

3. An apparatus according to claim 1, including structure associated with the base to maintain the downhole side in alignment with the cross-sectional diameter of the well.

4. An apparatus according to claim 1, including a plurality of arms with first and second ends, each first end attached proximate the center of the downhole side and each second end attached to one of the electrode tips.

5. An apparatus according to claim 1, including means attached to the base to selectively extend and retract the welding tips.

6. An apparatus according to claim 1, wherein one electrode is centrally mounted to the downhole side and initially charged as reference electrode, and the remaining electrodes are radially displaced around the reference electrode, and charged opposite the reference electrode.

7. An apparatus according to claim 1, including a cylindrical sleeve with an opening slideably mounted to extend over the base and cover the electrodes when extended, and to expose the electrodes when contracted.

8. An apparatus according to claim 7, including a plurality inside slips associated with the sleeve which when extended over the electrode tips narrows the sleeve opening to hold objects welded to the tips.

9. An apparatus according to claim 1, including means to electrically insulate the electrode tips from any liquids in the well.

10. An apparatus according to claim 9, wherein the means for electrically insulating the electrodes comprises a source of gas to provide a gas stream proximate the electrode tips, and surrounding structure associated with each electrode to direct the gas stream over the tips.

11. A method for retrieving objects from within a well, well bore, casing, and the like comprising:

providing a base with a downhole side;

retractively attaching to the base a plurality of electrodes with fusible tips biased to extend the tips from the downhole side in an initial pattern, said tips structured to displace and drag objects welded thereto in a manner minimizing snagging on the casing as the fishing tool is withdrawn;

running the base into the well to bring the electrodes into contact with the object;

generating signals as to the sequence in which each electrode contacts the object;

interpreting the signals to determine the orientation of the object within the well;

activating selsctively an electrical power source associated with the electrode tips to weld at least one electrode tip to the object; and retrieving the base and electrodes with the object welded thereto from the well.

* * * * *